US009327182B1

(12) United States Patent
Meak et al.

(10) Patent No.: US 9,327,182 B1
(45) Date of Patent: May 3, 2016

(54) TWO WHEELED RECREATIONAL BOARD

(71) Applicants: Frank Meak, Naples, FL (US); Demetrius Rejtano, Bargara (AU)

(72) Inventors: Frank Meak, Naples, FL (US); Demetrius Rejtano, Bargara (AU)

(73) Assignee: Frank Meak, Naples, FL (US)

( * ) Notice: Subject to any disclaimer, the term of this patent is extended or adjusted under 35 U.S.C. 154(b) by 0 days.

(21) Appl. No.: 14/593,005

(22) Filed: Jan. 9, 2015

Related U.S. Application Data

(60) Provisional application No. 61/976,119, filed on Apr. 7, 2014.

(51) Int. Cl.
*A63C 17/04* (2006.01)

(52) U.S. Cl.
CPC ..... *A63C 17/04* (2013.01)

(58) Field of Classification Search
CPC .... A63C 17/01; A63C 17/014; A63C 17/016; A63C 2203/40; A63C 2203/42; A63C 17/04
USPC ..... 280/87.021, 87.041, 87.042, 63
See application file for complete search history.

(56) References Cited

U.S. PATENT DOCUMENTS 5,046,747 A * 9/1991 Nielsen, Jr. ..... A63C 17/01 280/11.28
5,160,155 A * 11/1992 Barachet ..... A63C 17/0033 280/11.209
6,059,307 A * 5/2000 Western ..... A63C 5/124 280/609
6,338,494 B1 1/2002 Killian
6,398,237 B1 * 6/2002 Attey ..... A63C 17/01 188/29
6,832,771 B2 12/2004 Beck
6,926,294 B2 * 8/2005 Lewis ..... A63C 17/0046 280/87.041
7,172,205 B1 2/2007 Vujtech
7,213,823 B1 * 5/2007 Vujtech ..... A63C 17/004 280/87.021
7,980,578 B2 * 7/2011 Prior ..... A63C 17/12 280/221
8,025,300 B1 * 9/2011 Jordan ..... A63C 17/014 280/87.021
8,226,095 B2 * 7/2012 Reyes, Jr. ..... A63C 17/016 280/11.226
8,414,000 B2 4/2013 Chen et al.
8,579,306 B2 * 11/2013 Lewis ..... A63C 17/0046 280/87.042
8,777,240 B2 * 7/2014 Edginton ..... A63C 5/035 280/841

FOREIGN PATENT DOCUMENTS

| | | |
|---|---|---|
| CA | 2316842 | 7/1999 |
| CA | 2299008 | 10/2000 |
| CA | 2418259 | 1/2002 |
| WO | WO2012/113011 | 8/2012 |

* cited by examiner

*Primary Examiner* — John Walters
(74) *Attorney, Agent, or Firm* — Livingston Loeffler, P.A.; Edward M. Livingston, Esq.; Bryan L. Loeffler, Esq.

(57) ABSTRACT

A two wheeled recreational board (1) which an individual can ride across smooth or rough terrain. Wheels (11, 12) are mounted on an elongated board (2) in line with a central axis (9) of the elongated board and located proximate to a front end (3) and rear end (4), respectively, of the elongated board. The wheels are mounted on raised axles (13) that only allow a predetermined portion of the wheels to extend below the elongated board. This makes the board easier to maneuver without the board tipping over.

9 Claims, 2 Drawing Sheets

TWO WHEELED RECREATIONAL BOARD

CROSS-REFERENCE TO RELATED APPLICATION

This application claims priority to provisional patent application No. 61/976,119 filed on Apr. 7, 2014. The patent application identified above is incorporated herein by reference in its entirety to provide continuity of disclosure.

FIELD OF THE INVENTION

This invention relates to snowboarding and skateboarding related sports, and more particularly to a two wheeled board that can be ridden on hills with rough or smooth terrain.

BACKGROUND OF THE INVENTION

Skateboards have been popular for some years for use in both recreation and physical training. Snowboards also have become very popular for similar purposes in mountainous areas with sufficient levels of snow. It has been recognized that producing a skateboard for use on hard surfaces that mimics the response of a snowboard would allow users to practice snowboarding techniques in locations without snow. Such a device would be desirable in locations that do not receive any snow, and locations that receive snow during only a few months of the year. Although snowboarding is most closely associated with skiing, snowboard riders come to the sport from a number of other sports including skateboarding, surfing, and wakeboarding.

A typical skateboard has an elongated platform supported on four wheels with the platform located above the wheels. The skateboard user balances on the platform and adjusts the direction of travel by manipulating the pressure of his or her weight at various locations on the platform.

In the past there have been attempts at designing skateboards or wheeled snowboards to be used on unpaved terrain. However, these devices have had platforms with wheels mounted in a position that, similar to conventional skateboards, raise the platform an unsafe distance from the ground. This makes the devices unstable and difficult to maneuver especially on rough terrain.

Therefore, a need exists for a wheeled recreational board having raised wheel axles thereby keeping the lower surface of the board close to the ground so the board can be ridden safely over smooth or rough terrain while mimicking the movement of a snowboard. By keeping the platform as low as possible, the stability is increased, which in turn makes riding the board easier and safer.

The relevant prior art includes the following references:

| Pat. No. | Inventor | Issue/Publication Date |
|---|---|---|
| (U.S. Patent References) | | |
| 6,338,494 | Killian | Jan. 15, 2002 |
| 6,832,771 | Beck | Dec. 21, 2004 |
| 7,172,205 | Vujtech | Feb. 6, 2007 |
| 7,213,823 | Vujtech | May 8, 2007 |
| 8,025,300 | Jordan | Sep. 27, 2011 |
| 8,414,000 | Chen et al. | Apr. 9, 2013 |
| (Foreign Patent References) | | |
| CA2,316,842 | Attey | Jul. 15, 1999 |
| CA2,299,008 | Deschinkel | Oct. 26, 2000 |
| CA2,418,259 | Attey | Jan. 24, 2002 |
| WO2012/113011 | Morton | Aug. 30, 2012 |

SUMMARY OF THE INVENTION

The primary object of the present invention is to provide a wheeled recreational board having raised wheel axles thereby keeping the lower surface of the board close to the ground so the board can be ridden safely over smooth or rough terrain while mimicking the movement of a snowboard.

The present invention fulfills the above and other objects by providing a two wheeled recreational board which an individual can ride across smooth or rough terrain. The wheels are mounted on an elongated board in line with a central axis of the elongated board and located proximate to a front end and rear end, respectively, of the elongated board. The wheels are mounted on raised axles that only allow a predetermined portion of the wheels to extend below the elongated board. Therefore, the axles are preferably mounted above an upper surface of the elongated board so the centers of the wheels are also located above the top surface of the elongated board. This makes the board easier to maneuver without the board tipping over. The front end and rear end of the elongated board are preferably angled upward to prevent the board from catching on debris while being ridden. Bindings may also be provided to secure the individual's feet to the board.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
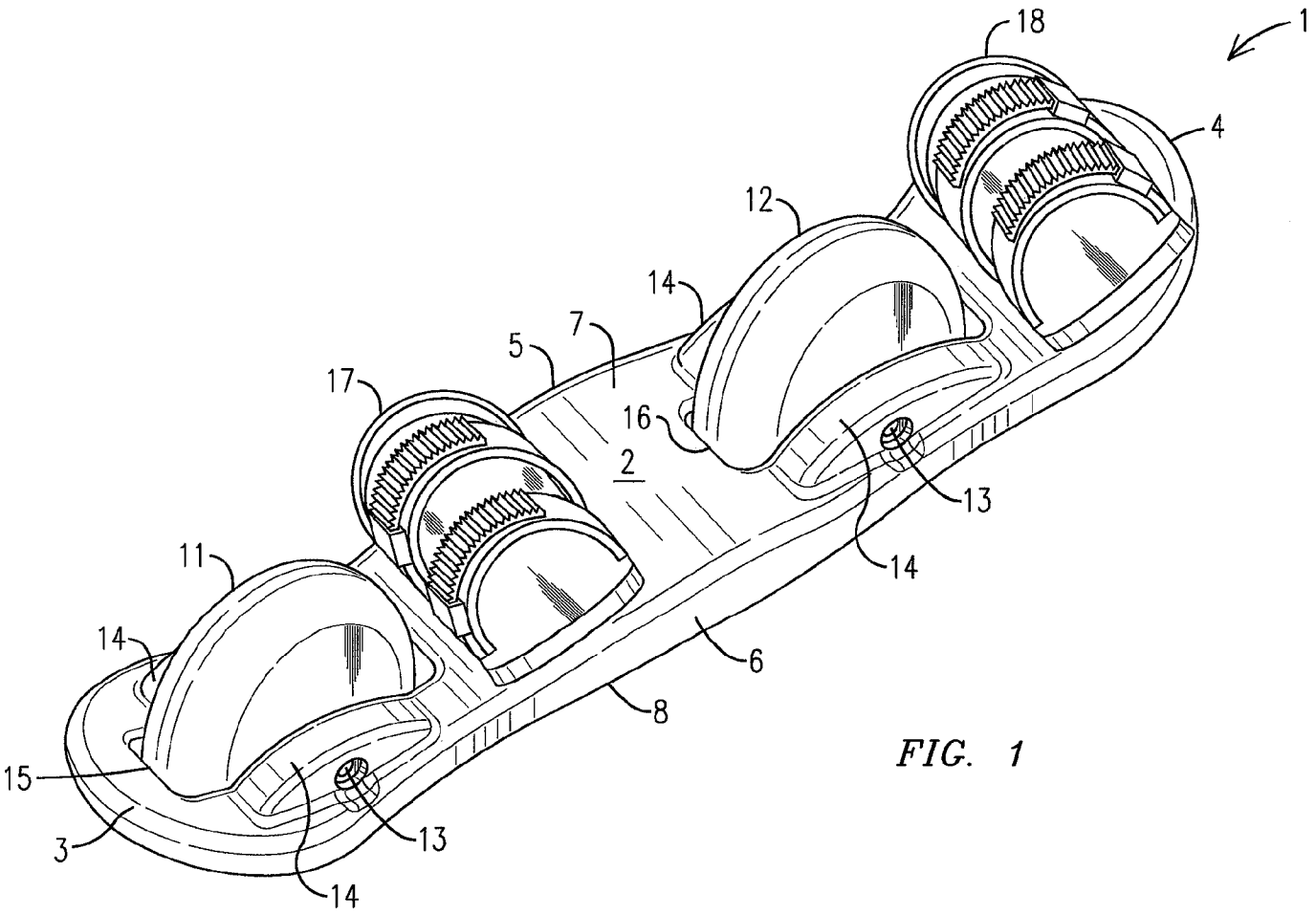
FIG. 1 is a perspective top view of a two wheeled recreational board of the present invention.
Figure 2:
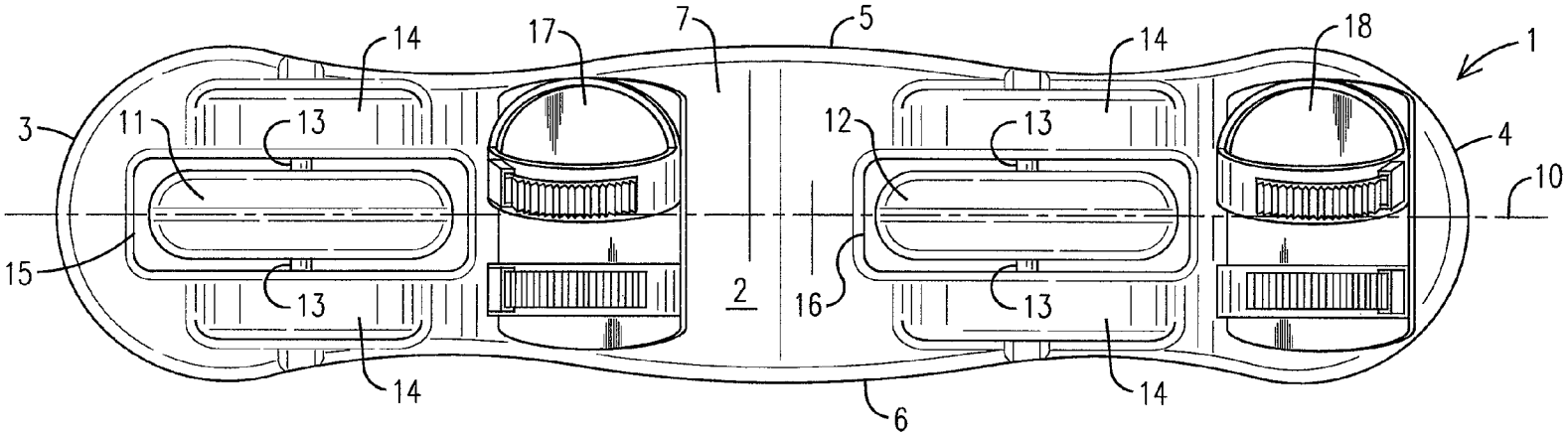
FIG. 2 is a top view of a two wheeled recreational board of the present invention.
Figure 3:
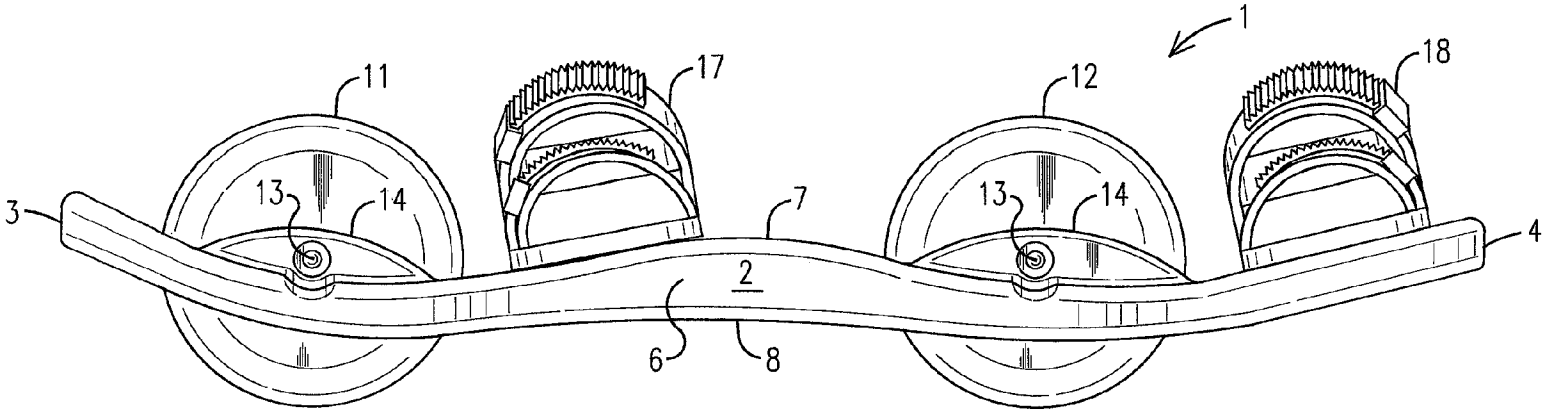
FIG. 3 is a side view of a two wheeled recreational board of the present invention.

For purposes of describing the preferred embodiment, the terminology used in reference to the numbered components in the drawings is as follows:

1. two wheeled recreational board, generally
2. elongated board
3. front end of elongated board
4. rear end of elongated board
5. right side of elongated board
6. left side of elongated board
7. top surface of elongated board
8. bottom surface of elongated board
9. central axis of elongated board
10. central portion of elongated board
11. front wheel
12. rear wheel
13. axle
14. raised mount
15. front slot
16. rear slot
17. front binding
18. rear binding With reference to FIGS. 1-5, the two wheeled recreational board 1 of the present invention comprises an elongated board 2 having a front end 3, a rear end 4, a right side 5, a left side 6, a top surface 7, a bottom surface 8 and a central axis 9 extending from the front end 3 to the rear end 4. The front end 3 and rear end 4 are preferably angled upward from a central portion 10 of the elongated board 2. A front wheel 11 and a rear wheel 12 are located on the elongated board 2 in line with the central axis 9 and proximate to the front end 3 and to the rear end 4, respectively. The wheels 11 and 12 are mounted on axles 13 which are secured to the elongated board via raised mounts 14 which extend upward a predetermined distance from the top surface 7 of the elongated board 2, thereby only allowing a predetermined portion of the wheels 11 and 12 to extend below the bottom surface 8 of the elongated board 2. The front wheel 11 and rear wheel 12 each pass through a front slot 15 and a rear slot 16, respectively. A front binding 17 is preferably secured to the top surface 7 of the elongated board 2 behind the front wheel 11 and proximate to the central portion 10 of the elongated board 2. A rear binding 18 is preferably secured to the top surface 7 of the elongated board 2 behind the rear wheel 11 and proximate to the rear end 4 of the elongated board 2.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

We claim:

1. A two wheeled recreational board comprising:

an elongated board having a front end, a rear end, a right side, a left side, a top surface, a bottom surface and a central axis extending from the front end to the rear end;

a front wheel and a rear wheel located on the elongated board in line with the central axis;

a front slot located in the elongated board through which the front wheel passes;

a rear slot located in the elongated board through which the rear wheel passes;

said front wheel being located proximate to the front end of the elongated board;

said rear wheel being located proximate to the rear end of the elongated board;

said front wheel and rear wheel each mounted on axles which are secured to the elongated board via raised mounts;

said raised mounts extending upward a predetermined distance from the top surface of the elongated board;

said front end of the elongated board located forward of the front wheel is angled upward in relation to a central portion of the elongated board;

wherein the front wheel is completely surrounded by the front slot and the front end.

2. The two wheeled recreational board of claim 1 wherein:

said rear end of the elongated board is angled upward in relation to a central portion of the elongated board.

3. The two wheeled recreational board of claim 1 further comprising:

a front binding secured to the top surface of the elongated board behind the front wheel and proximate to the central portion of the elongated board.

4. The two wheeled recreational board of claim 1 further comprising:

a rear binding secured to the top surface of the elongated board behind the rear wheel and proximate to the rear end of the elongated board.

5. A two wheeled recreational board comprising:

an elongated board having a front end, a rear end, a right side, a left side, a top surface, a bottom surface and a central axis extending from the front end to the rear end;

a front wheel and a rear wheel located on the elongated board in line with the central axis;

a front slot located in the elongated board through which the front wheel passes;

a rear slot located in the elongated board through which the rear wheel passes;

said front wheel being located proximate to the front end of the elongated board;

said rear wheel being located proximate to the rear end of the elongated board;

said front wheel and rear wheel each mounted on axles which are secured to the elongated board via raised mounts;

said raised mounts extending upward a predetermined distance from the top surface of the elongated board;

said front end of the elongated board located forward of the front wheel is angled upward in relation to a central portion of the elongated board;

said rear end of the elongated board is angled upward in relation to a central portion of the elongated board;

said rear end of the elongated board is angled upward in a manner in which the rear slot remains substantially level in relation to a central portion of the elongated board;

wherein the front wheel is completely surrounded by the front slot and the front end; and said front end of the elongated board is angled upward in a manner in which the front slot is also partially angled upward thereby exposing the front wheel.

6. The two wheeled recreational board of claim 5 further comprising:

a front binding secured to the top surface of the elongated board behind the front wheel and proximate to the central portion of the elongated board.

7. The two wheeled recreational board of claim 5 further comprising:

a rear binding secured to the top surface of the elongated board behind the rear wheel and proximate to the rear end of the elongated board.

8. A two wheeled recreational board comprising:

an elongated board having a front end, a rear end, a right side, a left side, a top surface, a bottom surface and a central axis extending from the front end to the rear end;

a front wheel and a rear wheel located on the elongated board in line with the central axis;

a front slot located in the elongated board through which the front wheel passes;

a rear slot located in the elongated board through which the rear wheel passes;

said front wheel being located proximate to the front end of the elongated board;

said rear wheel being located proximate to the rear end of the elongated board;

said front wheel and rear wheel each mounted on axles which are secured to the elongated board via raised mounts;

said raised mounts extending upward a predetermined distance from the top surface of the elongated board;

said front end of the elongated board located forward of the front wheel is angled upward in relation to a central portion of the elongated board;

said rear end of the elongated board is angled upward in relation to a central portion of the elongated board;

said rear end of the elongated board is angled upward in a manner in which the rear slot remains substantially level in relation to a central portion of the elongated board;

wherein the front wheel is completely surrounded by the front slot and the front end;

said front end of the elongated board is angled upward in a manner in which the front slot is also partially angled upward thereby exposing the front wheel; and a rear binding secured to the top surface of the elongated board behind the rear wheel and rear slot on the angled rear end of the elongated board.

9. The two wheeled recreational board of claim 8 further comprising:

a front binding secured to the top surface of the elongated board behind the front wheel and proximate to the central portion of the elongated board.

* * * * *